US010132044B2

(12) United States Patent
Couvreur et al.

(10) Patent No.: US 10,132,044 B2
(45) Date of Patent: Nov. 20, 2018

(54) RAIL CLIP ASSEMBLY

(71) Applicant: HF Holding S.A., Nivelles (BE)

(72) Inventors: Thierry Couvreur, Braine l'Alleud (BE); Michel Lens, Beersel (BE)

(73) Assignee: HF Holding S.A., Nivelles (BE)

( * ) Notice: Subject to any disclaimer, the term of this patent is extended or adjusted under 35 U.S.C. 154(b) by 180 days.

(21) Appl. No.: 15/307,224

(22) PCT Filed: Apr. 23, 2015

(86) PCT No.: PCT/EP2015/058776

§ 371 (c)(1),
(2) Date: Oct. 27, 2016

(87) PCT Pub. No.: WO2015/165790

PCT Pub. Date: Nov. 5, 2015

(65) Prior Publication Data

US 2017/0051457 A1 Feb. 23, 2017

(30) Foreign Application Priority Data

Apr. 28, 2014 (EP) ..... 14166148

(51) Int. Cl.
*E01B 9/32* (2006.01)
*B66C 7/08* (2006.01)

(52) U.S. Cl.
CPC . *E01B 9/32* (2013.01); *B66C 7/08* (2013.01)

(58) Field of Classification Search
CPC ..... E01B 9/02; E01B 9/10; E01B 9/32; E01B 9/42; E01B 9/60; E01B 9/66; B66C 7/08
(Continued)

(56) References Cited

U.S. PATENT DOCUMENTS 1,670,994 A * 5/1928 Snyder ..... E01B 9/32 238/343
3,923,245 A 12/1975 Marchant
(Continued)

FOREIGN PATENT DOCUMENTS

DE 10200480 A1 7/2003
EP 0258049 3/1988
(Continued)

*Primary Examiner* — Zachary L Kuhfuss
(74) *Attorney, Agent, or Firm* — Reinhart Boerner Van Deuren P.C.

(57) ABSTRACT

Rail clip assembly (1), comprising superposable first (10) and second bodies (11) arranged for being removably fastened to a rail support by a connector (9). The first body (10) comprises an abutment surface (121) adapted for abutment with a lateral face of a foot of a rail. The first and second bodies comprise corresponding apertures (122, 112) for receiving the connector (9), one (122) of the apertures being oblong with a longer axis (150) extending in a direction oblique to the abutment surface, to enable the first body to assume different positions relative to the second body. The first and second bodies comprise first corresponding surfaces (123, 111) configured for providing force transmitting contact between the first and second bodies when assembled. The rail clip assembly is characterized in that the first and second bodies comprise second corresponding surfaces (124, 114) configured to enter into force transmitting engagement with each other upon fastening the assembly, which have an inclination at an angle between 20° and 85° relative to the horizontal, such that the engagement of the second surfaces with each other produces a net resulting force on the first body oriented towards the rail and resisting backing movement of the first body away from the lateral face of the rail foot upon fastening the connector.

18 Claims, 7 Drawing Sheets

(58) Field of Classification Search
USPC ..... 238/347
See application file for complete search history.

(56) References Cited

U.S. PATENT DOCUMENTS

| | | | | | |
|---|---|---|---|---|---|
| 4,193,544 | A * | 3/1980 | Marchant | E01B 9/32 | 238/331 |
| 4,251,030 | A * | 2/1981 | Marchant | B66B 7/024 | 238/347 |
| 4,802,624 | A * | 2/1989 | Marchant | B66C 7/08 | 238/317 |
| 4,889,282 | A * | 12/1989 | Marchant | E01B 9/32 | 238/331 |
| 8,205,803 | B2 * | 6/2012 | Couvreur | E01B 9/10 | 238/351 |
| 9,657,445 | B2 * | 5/2017 | Awi Abalo | E01B 9/46 | |
| 2010/0193598 | A1 * | 8/2010 | Couvreur | E01B 9/10 | 238/351 |
| 2016/0002864 | A1 * | 1/2016 | Awi Abalo | E01B 9/46 | 238/297 |
| 2016/0024722 | A1 * | 1/2016 | Awi Abalo | E01B 9/46 | 238/297 |
| 2017/0051457 | A1 * | 2/2017 | Couvreur | B66C 7/08 | |

FOREIGN PATENT DOCUMENTS

| | | | | |
|---|---|---|---|---|
| EP | 0272874 | | 6/1988 | |
| EP | 1013827 | A1 * | 6/2000 | E01B 9/32 |
| FR | 744067 | | 4/1933 | |
| FR | 2240319 | | 3/1975 | |
| GB | 1599873 | | 10/1981 | |
| NL | 1003022 | | 11/1997 | |
| NL | 1003022 | C1 * | 11/1997 | E01B 9/32 |
| WO | WO 2009/013239 | A1 | 1/2009 | |

* cited by examiner

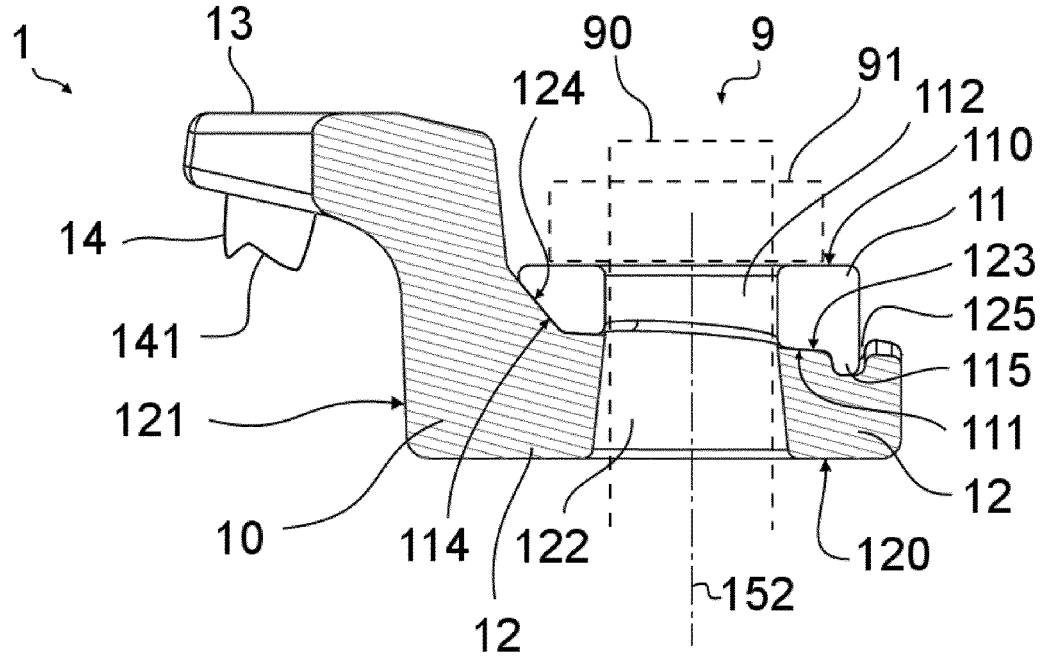
FIG 3: Z-Z

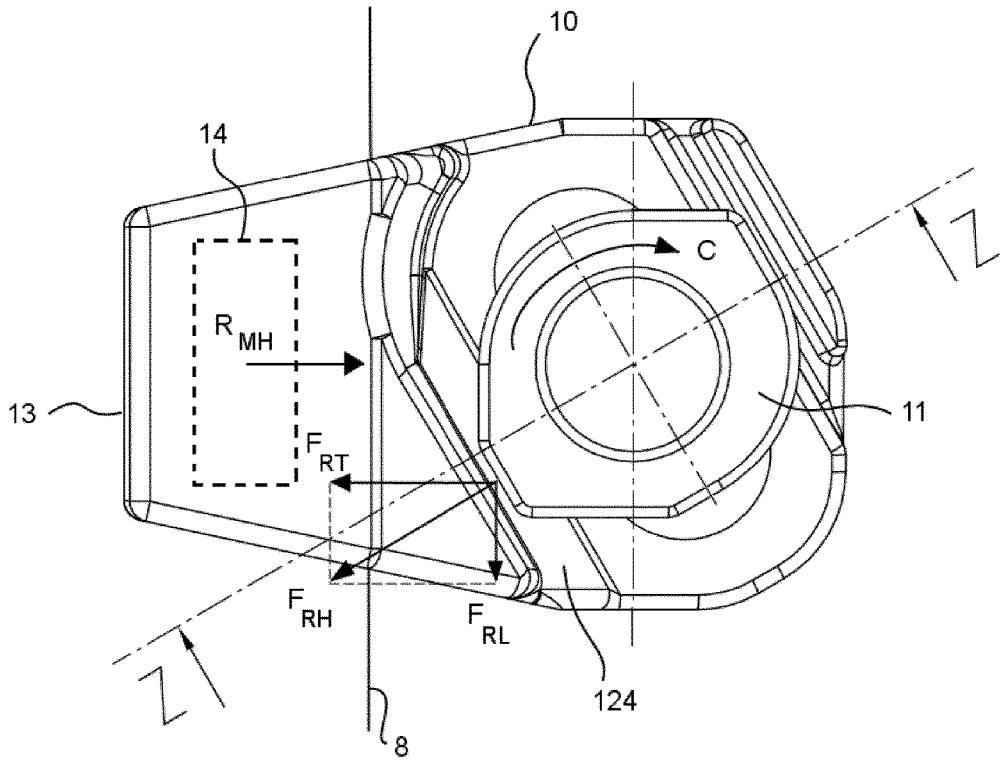
FIG 4 A
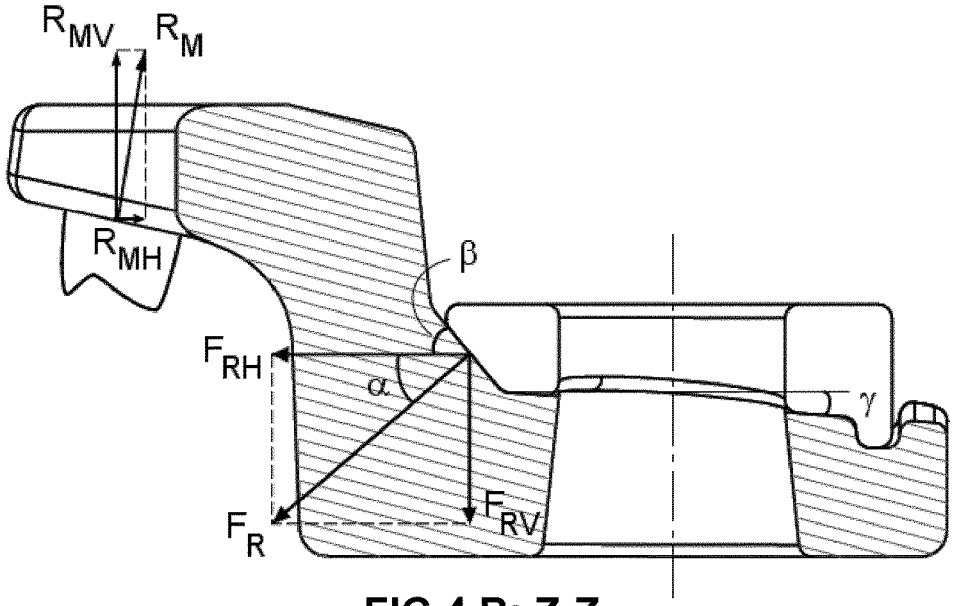
FIG 4 B: Z-Z

RAIL CLIP ASSEMBLY

The present invention is related to rail clip assemblies for fastening and securing a rail, such as a rail for travelling cranes, to a rail support, such as a flanged girder.

Rail clip assemblies of the above kind can roughly be divided in two basic types. A first type, which e.g. is known from EP 0272874 and WO 2009/013239, has two superposable bodies with a lower body fixed to a rail support and an upper body which overlies a portion of the rail foot on the one hand and overlies the lower body on the other. In this type of rail clip, the fixing of the lower body to the rail support and the fastening of the upper body on the lower body is distinctly made by independent fastening means. In the majority of cases, the lower body is welded to the rail support (made of steel), whereas the upper body is secured to the lower body by one or more bolts. A second basic type, which e.g. is known from GB 1599873 and EP 0258049, also has two superposable bodies, but both the upper and lower body are fixed to the rail support through a same fastener, typically a bolt or a stud. The first basic type is used for securing rails for heavier travelling machinery, such as gantry cranes in ports. Due to its more compact nature, the second basic type is more economical and finds application for securing rails for lightweight travelling machinery, such as overhead travelling cranes in small warehouses.

Both types of rail clip assemblies secure the rail based on a very simple principle. They aim at allowing enough freedom of vertical and rotational movement of the rail so that it can adjust to the wheels of the crane and avoid local constraints while maintaining the rail firmly in place with regard to lateral movement; hence the name "soft mounting". Other solutions that keep the rail too rigidly are prone to failure as significant forces are passed directly through these bindings, hence resulting in a loosening of joints, breaking of welds and bolts, etc. The soft mounting is obtained by ensuring that the rail clips lock the lateral movement of the rail while still allowing a limited vertical movement. This attenuated vertical clamping is obtained by providing the body part overlying the rail foot with a resiliently compressible member on its downward facing surface to provide resilient vertical clamping to the rail foot. The rail clips further engage in hard abutment against a lateral face of the rail flange. No resilience is provided for the lateral abutment, such that lateral motion of the rail is completely suppressed.

Upon fastening the rail clip, the resilient member is compressed between the overlying body part and the rail foot, and the overlying body part experiences a reaction force due to the compression which tends to back the body overlying the rail foot away from the rail. This backward movement is prevented in the rail clip assemblies of the first basic type by the lower body, which is already fixed to the rail support when the upper body is fastened and therefore the lower body backs up the upper body. However, such a fixed backing is missing in the rail clip assemblies of the second basic type. In the latter type of assemblies, both upper and lower bodies are secured to the rail support simultaneously through fastening with a same fastener, and, if no precautions are taken on fastening, the rail clip will end up being fastened without lateral contact with the rail foot. Therefore, when fastening rail clips of the second basic type, it is current practice to fasten the rail clip in two stages. In a first stage, the fastener (e.g. a nut and bolt) of the rail clip assembly is slightly fastened, such as by hand or a hand driven tool (wrench). As a reaction to the resilient member being squeezed between the rail foot and the overlying body part, the latter body part backs away from the rail foot, thereby losing contact with the lateral face of the rail foot. To bring the body back into abutment against the lateral face of the rail foot, the back of the body is then struck with a hammer. Thereafter, the fastener is fastened tightly, e.g. with a wrench. The above hammer strike ensures that the rail clip is brought laterally against the rail foot which ensures tight lateral fixation of the rail.

In addition, rail clips of the above kind may not be fastened with impact wrenches, but only with calibrated torque wrenches. In the latter ones, the torque is built up gradually by the wrench. This is not the case with impact wrenches, where the torque is delivered suddenly, causing a severe impact (hence the name impact wrench). Using an impact wrench would cause a random movement of the clip body parts, even after the hammer strike. However, the use of calibrated torque wrenches is time consuming.

It will be evident that a proper fixation of rail clip assemblies of the second basic type depends on the skill of the operator with deleterious effects when the rail clip is not properly mounted. Furthermore, the hammer strike is an additional mounting step which increases installation time, as does the required use of calibrated torque wrenches.

It is an object of the present invention to overcome the above mentioned problems in rail clip assemblies of the second basic type.

According to the present invention, there is therefore provided a rail clip assembly as set out in the appended claims. Rail clip assemblies according to the invention comprise superposable first and second bodies arranged for being removably fastened to a rail support by a connector. The first body comprises an abutment surface adapted for abutment with a lateral face of a foot of a rail. Either one of the first and second bodies comprises a projecting member and a resilient member. The projecting member is arranged for projecting from the abutment surface, for overlying the foot of the rail. The resilient member is attached to a downwards facing surface of the projecting member and is adapted to be interposed between the rail foot and the projecting member for providing resilient clamping of the foot of the rail. The first and second bodies comprise corresponding apertures for receiving the connector. One of the apertures is oblong with a longer axis extending in a direction oblique to the abutment surface, to enable the first body to assume different positions relative to the second body. The first and second bodies comprise first corresponding surfaces configured for providing force transmitting contact between the first and second bodies when assembled.

According to an aspect of the invention, the first and second bodies comprise second corresponding surfaces configured to enter into force transmitting engagement with each other upon fastening the assembly. The second surfaces are oriented in a direction of extent of the oblong aperture, and have an inclination at an angle between 20° and 85° relative to the horizontal when considered in a (vertical) plane perpendicular to the longer axis. The latter angle of inclination can be 30° or more and/or can be 80° or less, possibly 70° or less.

According to a further aspect, the first surfaces extend horizontally or inclined at an angle smaller than 20° relative to the horizontal when considered in the same place. The latter angle of inclination can be 15° or less, possibly 10° or less and/or can be larger than 0°, possibly larger than 1°, possibly larger than 2°.

With the above arrangement, it is advantageously obtained that the engagement of the second surfaces with each other produces a net resulting force on the first body oriented towards the rail and resisting backing movement of the first body away from the lateral face of the rail foot upon fastening the connector. It has been proven that rail clips according to the invention can correctly be installed by use of impact wrenches and without any further intervention, such as a hammer strike or the like. Rail clip assemblies according to the invention therefore can be installed in a correct position with greater ease and in less time compared to the prior art.

Additional advantageous aspects are set out in the dependent claims.

Aspects of the invention will now be described in more detail with reference to the appended drawings, in which same reference numerals indicate same features and wherein:

FIG. 3 represents a sectional view of the rail clip assembly of FIG. 1 along line Z-Z perpendicular to the longer axis of the oblong aperture;

FIGS. 4A and 4B represent the views of FIGS. 2 and 3 respectively with indication of the forces at play in the clip assembly;

Figure 1:
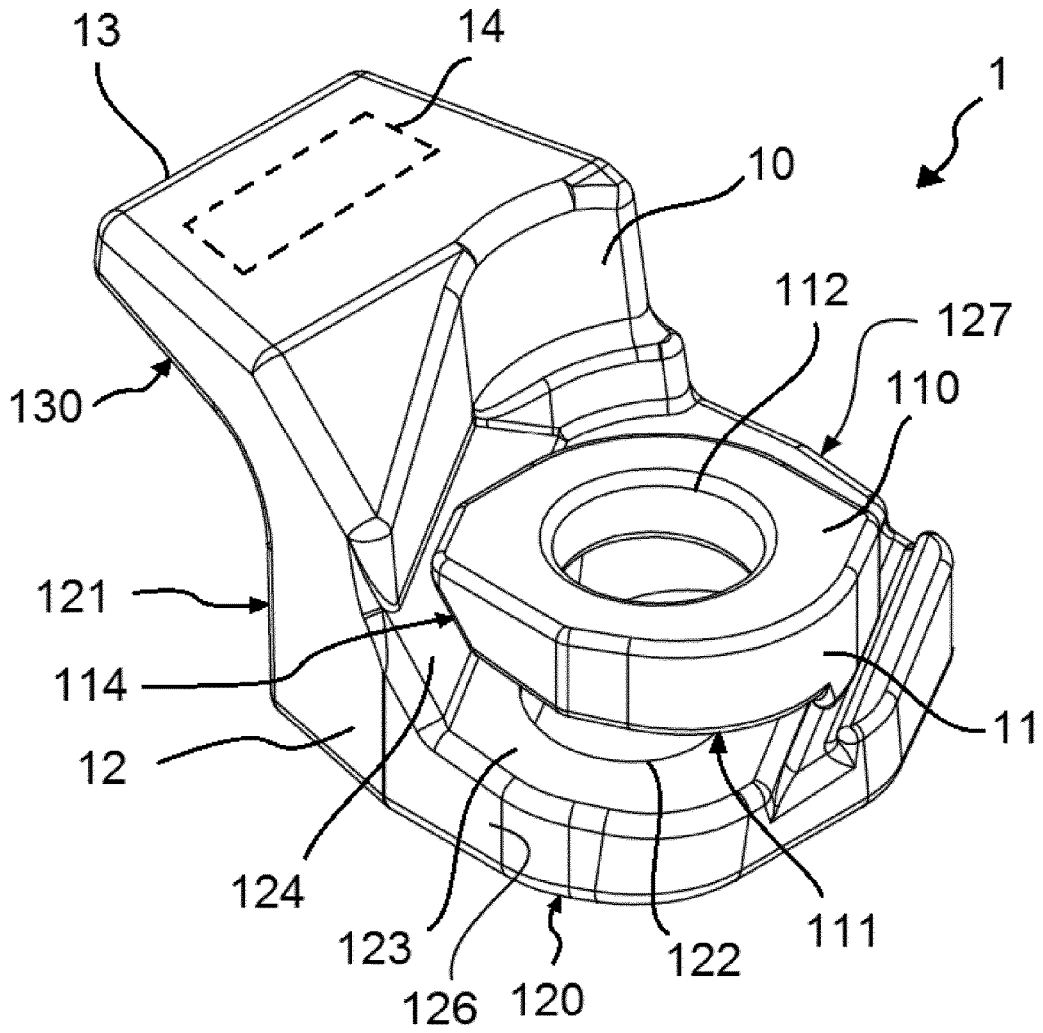
FIG. 1 represents a perspective view of a rail clip assembly according to the invention.
Figure 2:
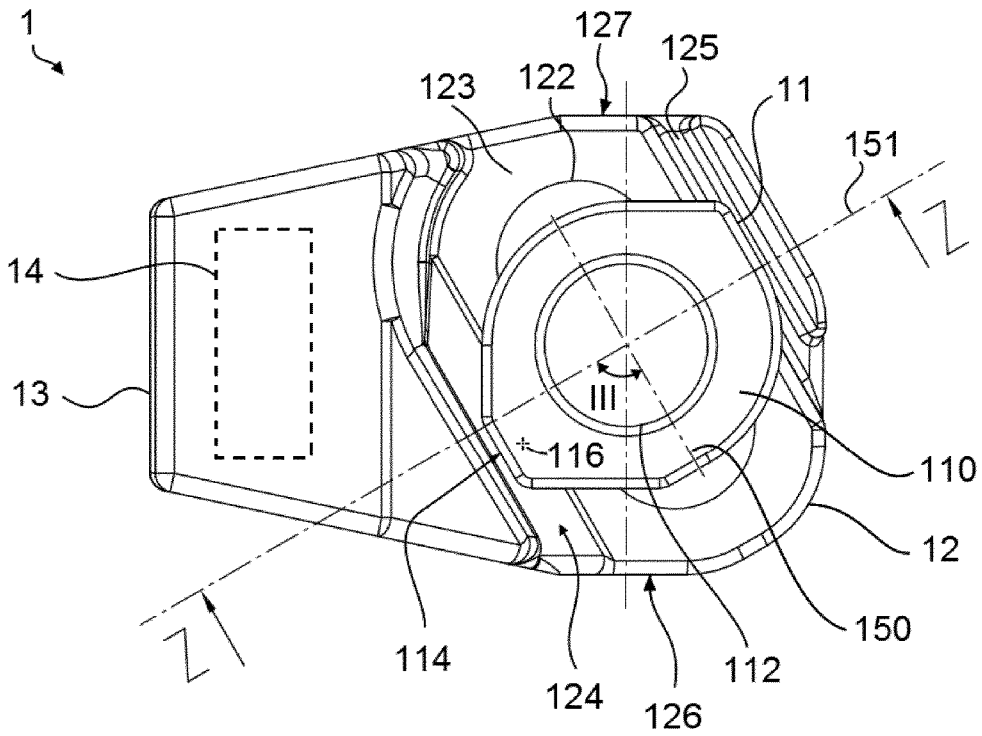
FIG. 2 represents a plan top view of the rail clip assembly of FIG. 1.

FIGS. 1-3 depict a first embodiment of rail clip assembly 1 according to the invention, comprising a first body 10 and a second body 11 which is superposable on the first body 10. The first body 10 is formed of a first portion 12 for overlying a rail support, such as a flanged girder (not shown), and a second portion 13, made integral with the first portion, for overlying a foot (or flange) of a rail (not shown). The second body 11 is arranged for overlying the first portion 12. The first body 10 therefore comprises an advantageously horizontal lower surface 120 arranged for resting in force transmitting contact on the rail support, and which advantageously extends throughout the first portion 12. The first body further comprises an advantageously substantially vertically extending abutment surface 121 arranged for abutment with a lateral (vertical) face of the foot of the rail. The abutment surface 121 is advantageously arranged at an edge of the lower surface 120.

The second portion of the first body is formed as a member 13 projecting from the abutment surface 121. A resiliently compressible member 14 (shown in broken lines on FIG. 1), which can be made of an elastomeric material, e.g. natural or synthetic rubber, is attached to a downwards facing surface 130 of the projecting member 13 such that it projects downwards from the surface 130 to provide an advantageously recessed bearing surface 141 (see FIG. 3) on the rail foot. Resilient member 14 is adapted to be interposed between the rail foot and the projecting member 13 for providing resilient clamping to the rail.

The function of the rail clip 1 is hence to rigidly clamp the rail in a lateral direction, through the abutment surface 121, while providing some resiliency in vertical direction, through the resiliently compressible member 14. It will be convenient to note that a resiliently compressible pad can additionally be provided underneath the rail, as is known in the art. It will also be clear that the abutment surface 121 is in direct force transmitting contact with the lateral face of the rail foot.

The first body 10 comprises an aperture 122 located in the first portion 12. The aperture 122 is a through hole extending from the lower surface 120 to an upper surface 123 of the first portion 12 and is sized for accepting a possibly threaded fastener 9, which can be formed of a bolt 90 or stud and nut 91 (shown in broken lines on FIG. 3). The second body 11, which is arranged to overlie the first portion 12 of the first body 10, comprises an aperture 112 corresponding to the aperture 122 in the first body 10, and which is sized for accepting the same fastener 9. The aperture 112 in the second body 11 is a through hole, extending from an upper surface 110 to a lower surface 111 of the second body 11. The fastener 9 hence is arranged for securing the first body 10 to the rail support and the first and second bodies to each other. It will be convenient to note that by unscrewing the fastener 9, both the first and the second bodies can be removed and adjusted, if desired.

In case the fastener 9 is a bolt, the head of the bolt will be in force transmitting contact with the support, e.g. flanged girder, on which the rail clip 1 is fastened. In case it is a stud, the stud will be secured to the support. In any case, it will be convenient to note that rail clip assemblies according to the present invention relate to the second basic type as indicated above, wherein the fastener for fastening the first and second bodies to each other also functions as fastener for fastening the assembly to the support.

The aperture 122 of the first body is oblong with a longer axis 150 extending in a direction oblique to the abutment surface 121 and hence oblique to a longitudinal direction of the rail. Suitable values of the angle between the longer axis 150 and the abutment surface 121 are between 20° and 50°, and advantageously not larger than 45°. The aperture 112 of the second body 11 is adapted to the shape of the fastener 90, and is typically circular (cylindrical), possibly of a size to fit the size of the corresponding portion of the fastener 90. The apertures 122 and 112 are arranged to cooperate to enable the first body 10 to assume different positions relative to the second body 11, along the direction of the longer axis 150.

The upper surface 123 of the first body 10 advantageously surrounds the oblong aperture 122, whereas the lower surface 111 of the second body 11 advantageously surrounds the circular aperture 112. When assembled, these surfaces 123 and 111 are in force transmitting contact, such that the tension of the fastener 9 is transmitted to the second body 11 and through the contacting surfaces 123 and 111 to the first body 10.

Advantageously, the upper surface 123 of the first body 10 is inclined relative to the horizontal in the direction of the longer axis 150. In this case, the lower surface 111 of the second body 11 is complementarily inclined. It will be convenient to note that along a section plane through the longer axis 150, both the second portion 12 of the first body 10 and the second body 11 are wedge shaped to obtain that the lower surface 120 of the first body 10 and the upper surface 110 of the second body 11 remain horizontal for all relative positions between the first and second bodies, thus preventing bending of the fastener 9. The inclination of surface 123 is such that the wedge shape of the second portion 12 of the first body 10 increases in thickness in the direction of the longer axis 150 towards the rail, e.g. the wedge shape increases in thickness from the lateral face 126 towards the opposite lateral face 127 of the first body 10. It will be evident that the second body 11 is complementarily wedge shaped to decrease in thickness in the direction of the longer axis 150 towards the rail. With such shaping of the bodies, if the rail tends to move laterally towards the body 10, the body 10 will tend to move in the direction of extent of oblong aperture 122 and in a direction of increase of thickness of the body 10, in the region of the fastener 9. This has the effect of increasing the tension in the fastener 9 and therefore increasing the frictional forces between the first body 10, the second body 11 and the rail support to resist further lateral movement of the rail. Suitable values of the angle of inclination of the upper surface 123 of the first body 10 relative to the horizontal in the direction of the longer axis 150 fall between 1° and 20°, advantageously 15° or less, advantageously 10° or less, advantageously at least 2°, advantageously between 4° and 7°.

In a direction 151 perpendicular to the longer axis 150 (i.e. in a section along a plane perpendicular to the longer axis 150), the upper surface 123 of the first body can be horizontal. Alternatively, the upper surface 123 can be inclined in the direction of axis 151, in addition to the inclination in the direction of the axis 150 described above. The latter inclination is advantageously at an angle γ (FIG. 4B) smaller than 20° relative to the horizontal when considered in the plane perpendicular to axis 150, advantageously at an angle smaller than or equal to 15°. A suitable value of the angle γ is e.g. 4°. The sense of the inclination is such, that the first portion 12 of the first body 10 is wedge shaped in the direction of axis 151 with thickness increasing in the direction of approach of the rail, i.e. in the direction of approach of the abutment surface 121. The second body 11 is complementarily wedge shaped in the direction of axis 151 to ensure that the upper surface 110 remains horizontal along all relative positions between the first and second bodies. When the clip is fastened to the rail support, the tension in the fastener 9 exerts through the second body 11 a resulting force on the first body 10 which is in the direction of axis 151 and therefore biases the first body 10 against the rail.

According to an aspect of the invention, the first body 10 comprises a second upper surface 124, advantageously arranged at an edge of the upper surface 123, and advantageously arranged between the oblong aperture 122 and the projecting member (second portion) 13 and/or abutment surface 121. The second upper surface 124 extends along a direction of extent of the oblong aperture 122 and has a slope relative to the horizontal which is oriented in the same direction as, but differs from the inclination of the upper surface 123 when considered in the direction 151 perpendicular to the longer axis 150. The second upper surface 124 is sloped such that the first body 10 (second portion 12) increases in thickness in the direction of approach of the rail, such as along axis 151, i.e. in the direction of approach of the abutment surface 121. In use, the second surface 124 forms a bearing surface for a second lower surface 114 of the second body 11, which is advantageously shaped complementarily to the second surface 124 of the first body 10.

Each of the second surfaces 124 and 114 are advantageously contiguous to the first surface 123 and 111 of the respective first and second bodies, i.e. respective first and second surfaces share a common edge.

The second surfaces 124 and 114 are inclined relative to the horizontal, advantageously at an angle β between 20° and 85°. The angle β is advantageously at least 30°, and advantageously 80° or less, advantageously 70° or less, measured in a plane perpendicular to axis 150. Suitable values for β fall between 40° and 50°. Although surfaces 124 and 114 are advantageously planar as depicted in the example of FIGS. 1-3, it will be convenient to note that a same effect can be obtained with a suitable combination of concave and convex surfaces, or with stair stepped surfaces which evolve along a same angle β as indicated above. A planar surface is however preferred, since it is most cost-effective in manufacture.

The width of the second surfaces 124, 114 (i.e. the extension of the second surfaces as measured in a plane perpendicular to axis 150) is not particularly limited, but is advantageously at least 4 mm, advantageously at least 5 mm.

It will be convenient to note that in the example of FIGS. 1-3, the inclination β of the second surfaces 114, 124 has a same sense as the inclination γ of the first surfaces 123, 111, but is more pronounced, i.e. the angle of inclination of the second surfaces is larger than the angle of inclination of the first surfaces in the same plane perpendicular to axis 150.

With the above disposition, it is obtained that, at the onset of assembling the rail clip 1 with fastener 9, the second surface 114 of the second body 11 promptly enters in a force transmitting engagement with the second surface 124 of the first body 10 to resist any backing movement of the first body 10 due to the compression of the resilient member 14 when the fastener 9 is fastened.

The obtained effect as best understood will now be described with reference to FIGS. 4A-B. Due to the corresponding second surfaces 124 and 114, the fastener 9 exerts through the second body 11 a net resulting force $F_R$ on the first body 10 which is oriented substantially in a plane perpendicular to the longer axis 150 and directed towards the rail and the rail support, i.e. the net resulting force $F_R$ experienced by the first body 10 has a downwardly directed and oblique orientation relative to the horizontal, directed towards the rail. The net resulting force $F_R$ hence has a nonzero vertical component $F_{RV}$ directed towards the rail support and a nonzero horizontal component $F_{RH}$ directed towards the rail 8, which is represented in FIG. 4A by a line 8 representing the position of the lateral face of the rail abutting against abutment surface 121. The horizontal component $F_{RH}$ can further be split in a (horizontal) component $F_{RL}$ parallel to the longitudinal direction of the rail and a (horizontal) component $F_{RT}$ transverse thereto. The reaction force $R_M$ exerted by the compression of the resilient member 14 on the first body 10 has both an upwards vertical component $R_{MV}$ and a horizontal component $R_{MH}$ directed away from the rail. From the force diagrams of FIGS. 4A-B, it can be seen that the transverse horizontal component $F_{RT}$ resists the horizontal component $R_{MH}$ causing backing movement and that the vertical component $F_{RV}$ resists the upward movement of $R_{MV}$. Since $F_{RT}$ maintains the first body 10 against the rail, it will be appreciated that the longitudinal component $F_{RL}$ advantageously resists the tendency to rotation of the first body 10 in the sense of the fastening torque C at the onset of fastening the fastener 9.

It will therefore be appreciated that the effects introduced by the second surfaces 124 and 114 come into play at the onset, i.e. at the very beginning, of fastening the rail clip 1, since it is at this instant of time that there is insufficient tension in the fastener 9 to provide sufficient friction between the lower surface 120 and the rail support, and likewise between the upper surface 123 of the first body and the lower surface 111 of the second body to compensate for backing movement and possibly rotation.

It will be convenient to note that once the second surfaces 124 and 114 enter into force transmitting contact, i.e. at the onset of fastening the assembly, advantageously no (substantial) relative displacement occurs between the two second surfaces.

The angle α of $F_R$ to the horizontal falls advantageously between 20° and 85°, and is advantageously at least 30° and advantageously at most 70°. It will be convenient to note that $F_R$ refers to the total net force resulting from the interaction of the second body 11 on the first body 10. At the onset of fastening the fastener, the net resulting force will be almost entirely caused by the engagement between the second surfaces 124 and 114.

In order to obtain a net resulting force directed towards the rail, the engaging parts of second surfaces 114, 124 and possibly of first surfaces 111, 123 are advantageously asymmetrically shaped relative to the axis 150. It will be convenient to note that a configuration as in FIGS. 7-9 of GB 1599873 has a symmetrical arrangement of surfaces 11a, 11b and 12a, 12b, which tend to centre the first and second bodies on the axis of the oblong aperture. Any resulting force on the first body is therefore oriented towards the centre of the aperture and not towards the rail.

It will be convenient to note that the second surfaces 124 and 114 provide a force resisting backing movement and possibly rotation of the first body when the fastener is not yet tensioned, or at the onset of tensioning. When the clip is assembled, with the fastener 9 under operational tension, the force resulting from the inclination of the surfaces 123 and 111 along axis 151 becomes more pronounced and takes over. Even though the latter inclination is less pronounced, a large resulting force is obtained due to a much larger area of contact between surfaces 123 and 111 as compared to the area of contact between the second surfaces 124 and 114.

The effect of resisting backing movement can be enhanced when the circular aperture 112 of the second body 11 advantageously has a narrow dimensional tolerance with respect to the dimensions of that part of the fastener 9 extending through the aperture 112 (e.g. stud or bolt 90). A suitable tolerance for the circular aperture 112 is an oversize of 0.7 mm or less, advantageously 0.6 mm or less, advantageously 0.5 mm or less, relative to the corresponding dimension (diameter) of the fastener 90. In addition, or alternatively, it will be advantageous to tolerance the dimension (distance) between the centreline 152 of the aperture 112 and the second surface 114 on the second body 11 with a positive deviation (i.e. oversize) compared to the dimension (distance) between the axis 150 of the oblong aperture 122 and the second surface 124 on the first body 10 of at least 0.1 mm, advantageously at least 0.25 mm. The positive deviation of the latter tolerance is advantageously less than or equal to 1 mm, advantageously less than or equal to 0.5 mm. With such tolerancing, it is ensured that the second surfaces enter into immediate engagement when the rail clip assembly is being mounted, even before the fastener 9 is tightened. To this same end, and in addition, or alternatively to the above, the inclination of the second surface 114 on the second body 11 can be made somewhat smaller than the inclination of the second surface 124 on the first body 10.

Advantageously, the second surface 114 of the second body 11 is shaped to be asymmetrical relative to a transverse median plane, i.e. a plane comprising the centre line 152 of the aperture 112 and perpendicular to axis 150. That is, the second surface 114 advantageously has a geometric centre 116 which is offset from the transverse median plane towards a side facing away from the rail. This can be seen in FIG. 2, where the second surface 114 of the second body 11 is substantially located in the third quadrant III formed by axes 150 and 151, i.e. the quadrant which is at the side of the rail, relative to axis 150, and facing away from the rail, relative to axis 151. The geometric centre 116 is hence located in the third quadrant III as well.

A groove 125 and corresponding projection 115 can be provided on the first and second bodies at ends of the surfaces 123 and 111 opposite the second surfaces 124 and 114 respectively. Groove 125 and projection 115 are aligned with axis 150. Sufficient play is provided between groove 125 and projection 115 such that there is no substantial force transmitting contact between the two. The purpose of the groove 125 and projection 115 is merely to ensure that the second body 11 is correctly oriented when assembling the rail clip.

It will be convenient to note that the provision of the second surfaces 124 and 114 particularly allows for using impact wrenches for fastening the fastener 9. With such impact wrenches, the fastening/tightening of the fastener occurs instantaneously hence not giving the rail clip sufficient time to position correctly by action of the surfaces 123 and 111. In these cases, the second surfaces 124 and 114 ensure an immediate effect.

Figure 5A:
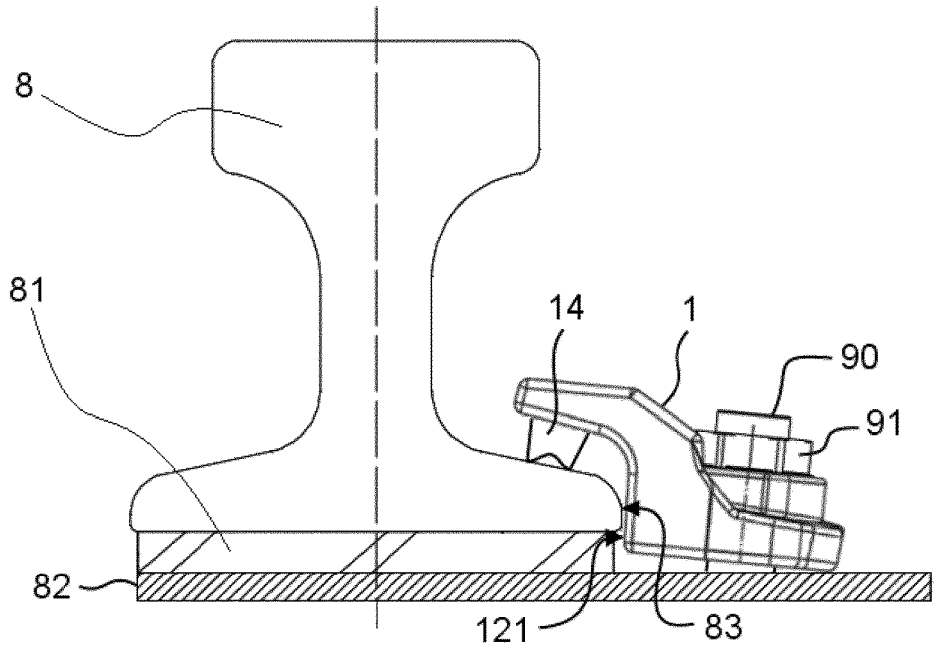
FIGS. 5A and 5B represent the setup of the rail clip assembly of FIGS. 1-3 at the foot of a rail on a non-fastened state (FIG. 5A) and in a fastened state (FIG. 5B)
Figure 5B:
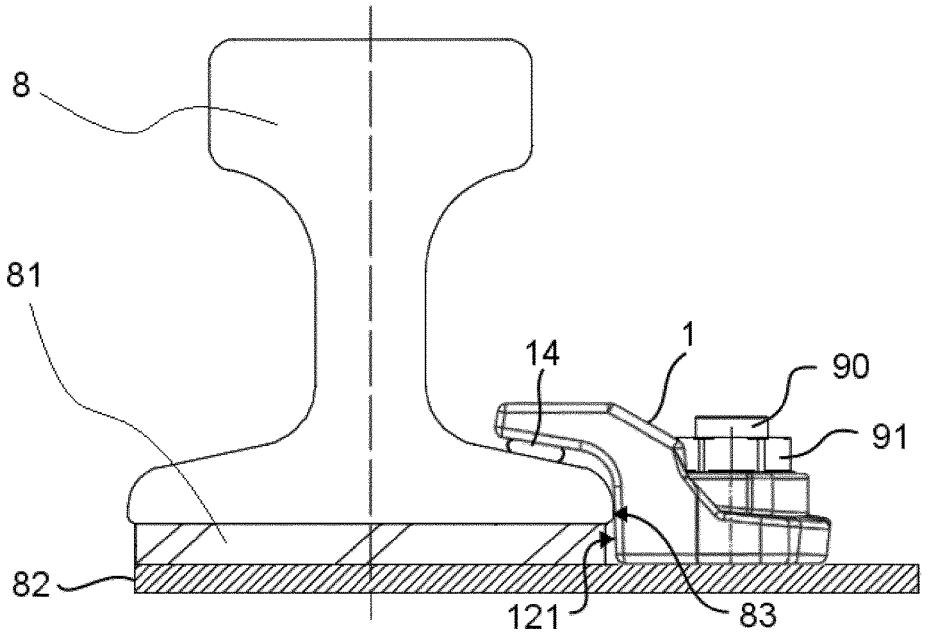

The suitability of the above rail clip for use with impact wrenches was tested in an experiment involving three different rail clip assemblies as described above with regard to FIGS. 1-3. A first rail clip assembly was designed for a force of 35 kN and two other rail clip assemblies were designed for respectively 75 kN and 125 kN. In the three rail clips, the angle β varied between 40° and 50°, the angle γ was 4° and the inclination of surface 123 in the direction of axis 150 varied between 4° and 7°. For each of the three rail clips, a separate assembly was made as shown in FIG. 5A, in which the rail clip was placed on a steel plate support 82 to abut against the foot of a rail 8. A resilient pad 81 was placed between the rail 8 and the steel plate 82 as is customary in the field. The rail clip 1 was installed, such that the abutment surface 121 of the first body 10 was placed against the lateral face 83 of the rail foot. It can be seen in FIG. 5A, that when the bolt 90 and nut 91 are not fastened, the resilient member 14 is resting on the flange of the rail 8 and the assembly is lifted up from the support 82 leaving a gap between 2 mm and 6 mm, depending on the size of resilient member 14 and the geometry of the rail. Following set up, the nut was fastened using an impact wrench. Fastening causes the resilient member 14 to be squeezed until the first body 10 assumes full contact with the support 82. It was observed with all three rail clips that were tested, that the rail clip remained in correct abutment against the lateral face 83 of the rail 8 as shown in FIG. 5B, when using an impact wrench and even without needing to hold the clip in position by hand or otherwise. This would not have been the case if the second surfaces were not present, since the squeezing of the resilient member, which is squeezed a considerable amount, typically to between 20% and 50% of its initial thickness, causes in turn a backing movement such that the rail clip loses contact with the lateral face of the foot of the rail.

Figure 6:
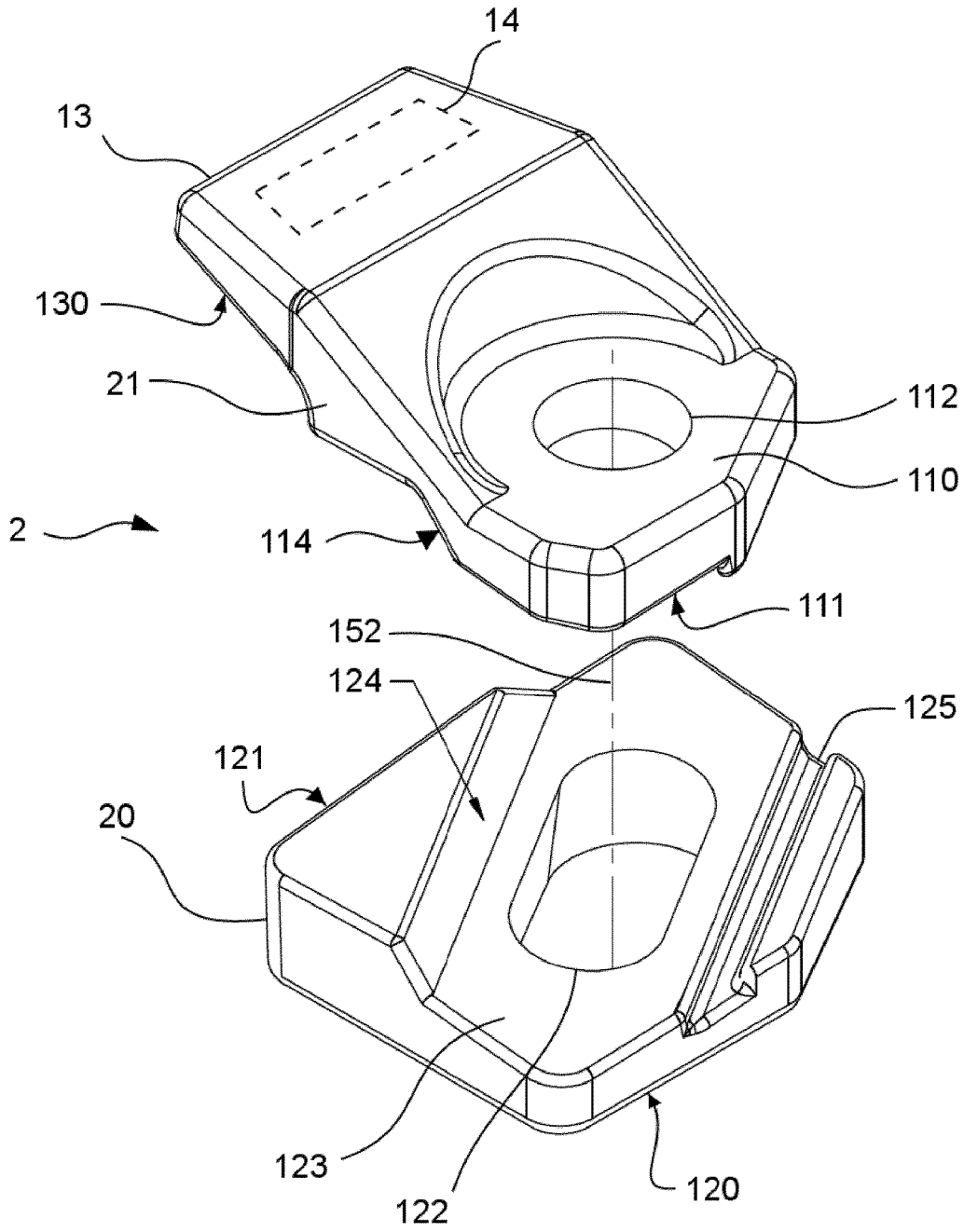
FIG. 6 represents an exploded perspective view of another rail clip assembly according to the invention.
Figure 7:
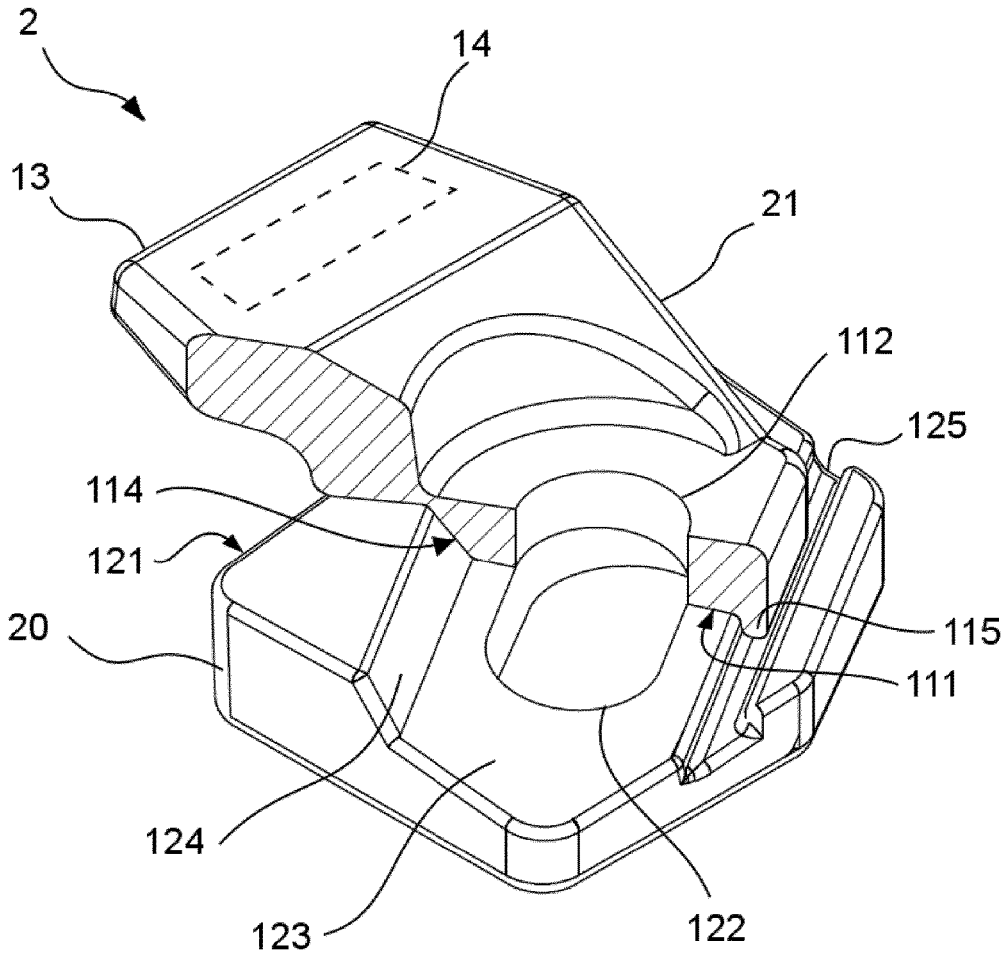
FIG. 7 represents the rail clip assembly of FIG. 6 in perspective view and with partial cut out of the second body.

A second example of rail clip assembly 2 according to aspects of the invention is depicted in FIGS. 6 and 7. The clip assembly 2 differs from the clip assembly 1 in that the member 13 arranged for overlying the rail foot is made integral with the second body 21, instead of the first body 20. The abutment surface 121 is however still included on the first body 20. The second surface 124 on the first body 20 and the second surface 114 on the second body are oriented in the same way as in the clip assembly 1 and the net resulting force is hence the same. The effect obtained by the second surfaces here is to resist backing movement of the first body 20 away from the rail at the onset of fastening and rotation of the first body 20 relative to the rail support due to the tensioning torque. Compared to the rail clip assembly 1, clip assembly 2 is bulkier and heavier, and therefore possibly less interesting from an industrial point of view.

Either one, or both the first and second bodies can be made of cast iron, or alternatively steel.

The invention claimed is:

1. Rail clip assembly (1, 2), comprising a first body (10, 20) and a second body (11, 21), wherein the first and second bodies are arranged for being superposable on each other and for being removably fastened to each other and to a rail support by a same connector (9), and wherein:

the first body (10, 20) comprises an abutment surface (121) adapted for abutment with a lateral face (83) of a foot of a rail (8), either one of the first and second bodies comprises a projecting member (13), projecting from the abutment surface when assembled and adapted for overlying the foot of the rail, and a resilient member (14) attached to a downwards facing surface (130) of the projecting member and adapted to be interposed between the rail foot and the projecting member for providing resilient clamping of the foot of the rail, the first and second bodies comprise corresponding apertures (122, 112) for receiving the connector (9), one (122) of the apertures being oblong with a longer axis (150) extending in a direction oblique to the abutment surface, to enable the first body to assume different positions relative to the second body, the first and second bodies comprise first corresponding surfaces (123, 111) configured for providing force transmitting contact between the first and second bodies when assembled, characterised in that the first and second bodies comprise second corresponding surfaces (124, 114) configured to enter into force transmitting engagement with each other upon fastening the assembly, wherein the second surfaces extend in a direction of extent of the oblong aperture (122) and have an inclination at an angle between 20° and 85° relative to the horizontal when considered in a plane perpendicular to the longer axis (150), and wherein the first surfaces (123, 111) extend horizontally or inclined at an angle smaller than 20° relative to the horizontal when considered in the plane, such that the engagement of the second surfaces with each other produces a net resulting force on the first body oriented towards the rail and resisting backing movement of the first body away from the lateral face of the rail foot upon fastening the connector.

2. Assembly of claim 1, wherein the second surfaces (124, 114) are shaped and dimensioned to apply a net resulting force to the first body having a horizontal component (FRH) oriented in a direction cross to the longer axis towards the rail and a vertical component (FRV) directed downwards towards the rail support.

3. Assembly of claim 1, wherein the first surfaces (123, 111) are oblique relative to the horizontal in the direction of the longer axis (150) to increase tension in the connector (9) for resisting laterally directed forces applied by the rail to the clip assembly.

4. Assembly of claim 1, wherein the first surfaces (123, 111) extend inclined relative to the horizontal when considered in the plane perpendicular to the longer axis (150), such that the first body (10, 20) is wedge shaped in a cross section perpendicular to the longer axis (50) with thickness increasing in the direction of approach of the rail.

5. Assembly of claim 1, wherein a distance from a centre axis (152) of the other one (112) of the apertures to the second surface (114) of the corresponding first or second body is overdimensioned relative to a corresponding distance from the longer axis (150) to the second surface (124) of the body (10, 20) comprising the oblong aperture (122) by at least 0.1 mm.

6. Assembly of claim 1 wherein the angle of inclination of the second surface (124) of the body (10) comprising the oblong aperture (122) is larger compared to the angle of inclination of the second surface (114) of the other one (11) of the first and second bodies.

7. Assembly of claim 1, wherein the other one (112) of the apertures is circular of a size corresponding to a size of the connector (9) which is threaded.

8. Assembly of claim 7, wherein the circular aperture (112) has a diameter dimensioned with a tolerance smaller than or equal to 0.7 mm compared to a corresponding diameter of the connector (9).

9. Assembly of claim 1, wherein the oblong aperture (122) is located on the first body (10, 20) and the second surface (114) of the second body (11, 21) has a geometric centre (116) which is offset from a plane, which is perpendicular to the longer axis (150) and comprises a centre axis (152) of the aperture of the second body, towards a side facing away from the rail.

10. Assembly of claim 1, wherein the second surfaces (124, 114) are planar.

11. Assembly of claim 1, wherein the inclination of the second surfaces is obtained by a stair stepped shape.

12. Assembly of claim 1, wherein at least one of the second surfaces (124, 114) has a width of at least 4 mm when measured in the plane perpendicular to the longer axis (150) and along that second surface.

13. Assembly (10) of claim 1, wherein the projecting member (13) is made integral with the first body (11) and wherein the oblong aperture (122) is provided in the first body.

14. Assembly of claim 1, wherein the second body (11, 21) is superposable on the first body (10, 20), such that the second body overlies a portion (12) of the first body when assembled.

15. Assembly of claim 1, wherein, when assembled, the second surfaces (124, 114) are interposed between the oblong aperture (122) and the abutment surface (121).

16. Assembly of claim 1, wherein one of the first and second bodies comprises a projection (115) and the other one of the first and second bodies comprises a corresponding groove (125) accepting the projection and aligned with the longer axis (150) for correctly orienting the first and second bodies relative to one another.

17. Assembly of claim 16, wherein the groove (125) and the projection (115) are provided at edges of the first surfaces (123, 111) opposite the second surfaces (124, 114).

18. Assembly of claim 1, comprising the connector (9), which when accepted and fastened through the apertures (122, 112), is arranged for securing the first body (10) to the rail support and for securing the first and second bodies to each other.

* * * * *